United States Patent [19]

Saxby et al.

[11] Patent Number: 4,524,877

[45] Date of Patent: Jun. 25, 1985

[54] PRESSURIZING AND CLOSURE APPARATUS FOR CARBONATED BEVERAGE CONTAINERS

[76] Inventors: Willard A. Saxby, 285 Old Farm Dr., Newington, Conn. 06111; Robert D. Pikula, 116 Johnny Cake La., Glastonbury, Conn. 06033

[21] Appl. No.: 569,569

[22] Filed: Jan. 9, 1984

[51] Int. Cl.[3] ..... B65B 31/04

[52] U.S. Cl. ..... 215/228; 215/260; 53/88

[58] Field of Search ..... 215/228, 260; 53/88

[56] References Cited

U.S. PATENT DOCUMENTS

| | | | |
|---|---|---|---|
| 1,601,705 | 9/1926 | Staunton | 53/88 X |
| 2,648,474 | 8/1953 | Crook | 53/88 X |
| 3,853,222 | 12/1974 | Helms | 53/88 X |
| 4,033,091 | 7/1977 | Saponara | 215/228 X |
| 4,287,819 | 9/1981 | Emerit | 215/260 X |

*Primary Examiner*—Steven M. Pollard

*Attorney, Agent, or Firm*—Alan E. Steele

[57] ABSTRACT

A pressurizing and closure apparatus for carbonated beverage containers. The apparatus is inserted and secured to the container's mouth and a hand pump pressurizes the container to a pressure greater than the surface pressure of the carbonated beverage. A valve then seals the pressurized container from the pressurizing apparatus as the hand pump is slightly withdrawn from its bottom position.

6 Claims, 2 Drawing Figures

PRESSURIZING AND CLOSURE APPARATUS FOR CARBONATED BEVERAGE CONTAINERS

SPECIFICATION

This invention relates to a pressurizing and closure device for carbonated beverage containers. The prior art devices have utilized cumbersome and expensive devices which requires multi valving arrangements, bellows type spring pump devices, and or spring loaded ball type valves. These devices by itself or in combination were costly and bulky when stored with the container. The device when utilized with a carbonated beverage container should be compact, inexpensive and be able to retain the pressure in the container to avoid "fizz-out" of the stored beverage. "Fizz-out" occurs when the carbonated beverage loses its' gases to the open volume in the container when stored. This occurs when the pressure of the gases in the beverage is equal to or greater than the pressure of the unoccupied volume surface of the beverage. By pressurizing this open volume to a pressure greater than the pressure of the gases in the carbonated beverage and maintaining this pressure you avoid "fizz-out".

In view of the above, the main object of this invention is to provide a pressurizing and closure device for a carbonated beverage container which is compact with few moving parts.

Another object is to provide a pressurizing and closure device which can be manipulated by hand to pressurize the beverage container.

Still another object is to provide a pressurizing and closure device for a carbonated beverage container which can be stored with the container and maintain the pressure in the container after it has been pressurized.

Yet another object of this invention is to provide a hand pump which does not have any linkages and is easily stored with the closure device.

Other features and many of the attendant advantages of this invention will be readily appreciated as the invention becomes better understood from the following description taken in connection with the illustrative embodiments in the accompanying drawings wherein.

Figure 1:
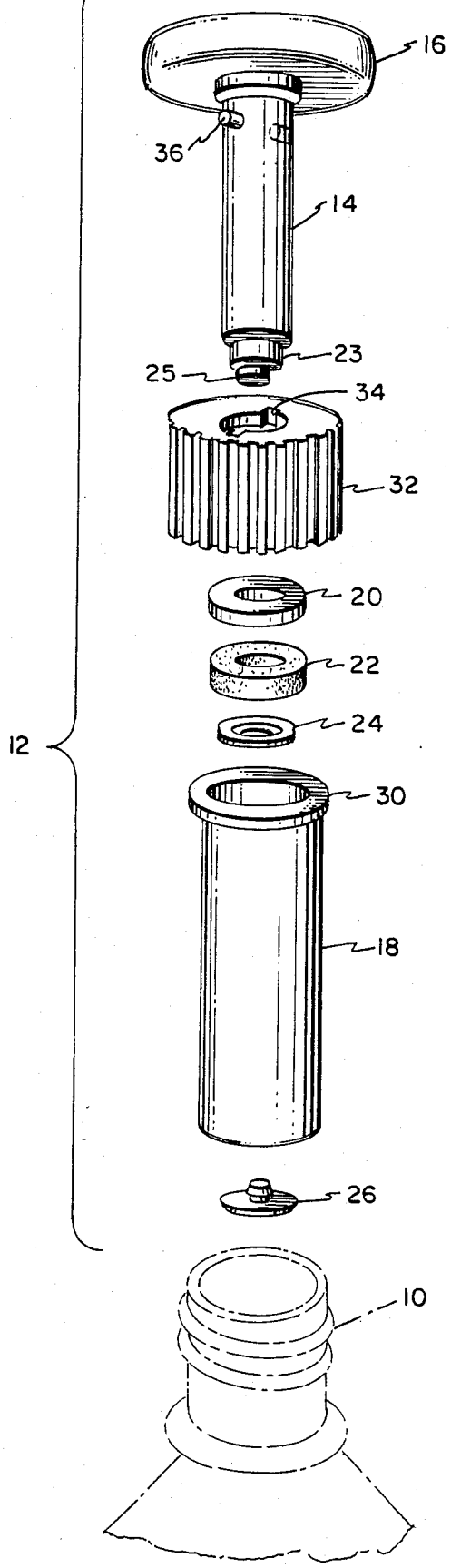
FIG. 1 shows an exploded view of the pressurizing and closure device and the carbonated beverage container it fits into.
Figure 2:
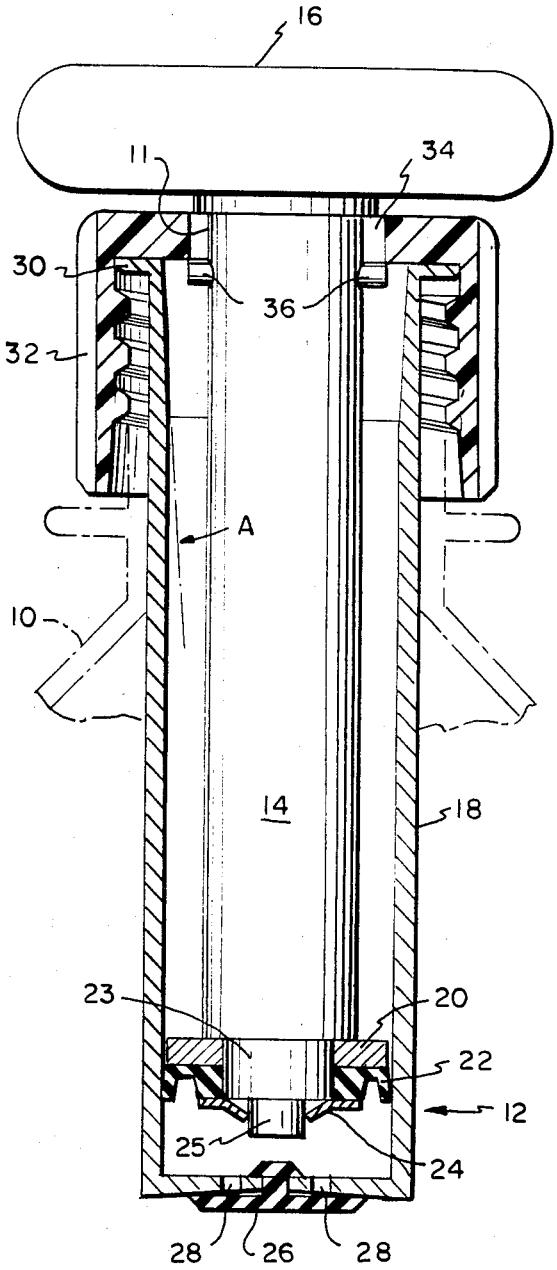
FIG. 2 shows a section through the center of the pressurizing and closure device.

Referring to the drawings and initially to FIG. 1 there is seen a carbonated beverage container 10, with a pressurizing and closure device 12 inserted in the mouth of the container 10. FIG. 2 shows a section through the pressuring and closure device 12. The cylinder 18 has a threaded cap 32 mounted at one end and a piston 14 passing through circular opening 11 in cap 32 and centrally located in said cylinder 18. The cap 32 is threaded to the outside threads at the mouth of container 10 until it abuts the cylinder flange 30 which retains the cap 32 and seals container 10. One end of piston 14 extends through the opening in cap 32 and has a piston grip 16 affixed to it at that end. The other end of piston 14 has a stepped portion 23 on which is mounted a back-up washer 20, and a circular cup seal 22, abutting said back-up washer 20. A smaller stepped portion 25 integral with the end of piston 14 has retainer washer 24 mounted thereon which abuts the inner portion of cup seal 22 in such a manner as to hold cup seal 22 snugly against back-up washer 20. The bottom of cylinder 18 has an axially mounted resilient pressure valve 26. Axially located on either side of nib portion of said pressure valve 26 are two ports 28. Each port 28 is located an equal distance from the axis of the cylinder, but well within the diameter of the head portion of pressure valve 26 which is located outside of the bottom wall of cylinder 18. Two locking tabs 36 are 180° apart and affixed to the upper portion of piston 14. Two slots 34 extend from the circular opening 11 of cap 32 in such a manner that they are 180° apart and long enough to allow tabs 36 on piston 14 to pass through them. The uppermost portion of the internal surface of cylinder 18 has a relief angle A.

After a portion of carbonated beverage has been removed from container 10, the container must be sealed and pressurized in such a manner as to keep the gas from the beverage from filling the volume left by the dispensed beverage and also from escaping from the container itself. This is accomplished by the operation of the pressurizing and closure apparatus which is as follows. The assembled pressurizing and closure device 12 is inserted into the mouth of container 10, and the threaded cap 32 is securely threaded to the outside threads on the container until flange 30 on cylinder 18 abuts the underside of cap 32 to seal the container 10. The piston grip 16 is then rotated so as to align the tabs 36 on piston 14 with the slots 34 on the opening 11 of cap 32. The piston 14 is withdrawn from cylinder 18, wherein the tabs 36 pass through slots 34, until the cup seal 22 at the other end of piston 14 enters the uppermost portion of the cylinder 18 which has a relief formed by the angle A. The outer periphery of cup seal 22 is in sealing contact with the inner walls of cylinder 18 until it reaches the upper relieved portion of cylinder 18. The angle A is such that the inner diameter of cylinder 18 in this relieved portion is greater than the outer diameter of cup seal 22 so that cup seal 22 is not in sealing contact with the inner walls of the cylinder in this relieved portion. When the cup seal 22 is in this relieved portion the piston 14 is in the uppermost part of its stroke. In this uppermost part of the stroke air is allowed to flow in through the slots 34 and the clearance between opening 11 and piston 14, around the cup seal 22 and into the body of cylinder 18. On the downstroke of the piston 14, the cup seal 22 leaves the relieved portion of the cylinder and again is in sealing contact with the inner wall of cylinder 18. The air below cup seal 22 in the body of cylinder 18 is therefore trapped below cup seal 22, and as the stroke continues downwardly, pressure valve 26 is opened by the pressure of the entrapped air being pushed against it through ports 28. After the piston reaches the bottom of the downstroke, the piston 14 is again withdrawn by hand to start another upstroke. As the upstroke begins, the withdrawal of the cup seal 22 from the bottom of the cylinder creates a slight vacuum which draws the pressure valve 26 up to close ports 28. At the end of the upstroke additional air enters the body of the cylinder 18 and the downstroke commences to compress the air, open pressure valve 26 and thereby increase the pressure in container 10. This pumping action is continued until resistance to pumping occures. When this resistance occurs it is an indication that the pressure in the container 10 is greater than the gas in the carbonated beverage. At this time the piston 18 is pushed to its lowermost position, rotated 180° and withdrawn until the tabs 36 hit the underside of the top of cap 32. This slight withdrawal causes the valve 26 to close ports 28, and the pressurizing and closure apparatus is in position to be stored with the container. During the stored condition the pressure in container 10 is maintained by the closing of ports 28 in the cylinder and the sealing of cylinder flange 30 with the underside of cap 32. In the event the resilient valve 26 allows some air to escape through ports 28, then cup seal 22 acts as an additional barrier from allowing this air escape through the cylinder 18.

Having thus described the invention and advantages thereof, it will be understood that the foregoing disclosure relates not only to preferred embodiments of the invention, but it is also intended to cover all changes and modifications of the invention selected for the purpose of disclosure without departing from the true spirit and scope thereof.

I claim:

1. A pressurizing and closure apparatus for a carbonated beverage container comprising:

(a) a hollow cylinder having one open end, (b) a threaded cap having a central opening, and abuts the open end of said cylinder, (c) a piston mounted in said cylinder with one end of said piston extending through the central opening in said cap, (d) a piston grip at the end of the piston extending outside of said cylinder, (e) a seal mounted on the opposite end of said piston for sealing the piston against the inner walls of said cylinder, (f) one or more ports located in the closed end of said cylinder, (g) valve means mounted in the closed end of said cylinder which allows air to be displaced through said ports from said cylinder on the downstroke of the piston, and seals the ports on the upstroke of said piston, (h) locking means on said piston for locking the piston in the downstroke position when the apparatus is stored within a carbonated beverage container.

2. A pressurizing and closure apparatus of claim 1 wherein the seal mounted at the end of the piston is a cup seal.

3. A pressurizing and closure apparatus of claim 1 wherein the upper inner wall portion of the cylinder towards its open end has a relief taper so that the piston seal on the upstroke does not contact the inner walls in said portion of the cylinder.

4. A pressurizing and closure apparatus of claim 2 wherein the hollowed out portion of the cup seal faces the closed end portion of the cylinder.

5. A pressurizing and closure apparatus of claim 2 wherein the valve and the cup seal act in tandem to seal the container against loss of pressure when the apparatus is in the stored position.

6. A pressurizing and closure apparatus of claim 1 wherein the locking means are two tabs on the piston located 180° apart, which engage the underside of the cap when the piston grip is angularly rotated from its pumping position.

* * * * *